US009327742B2

(12) United States Patent
Ookita et al.

(10) Patent No.: US 9,327,742 B2
(45) Date of Patent: May 3, 2016

(54) IN-VEHICLE INFORMATION DISPLAY SYSTEM AND METHOD IMPLEMENTING ALTERNATING-CURRENT POWER AND DIRECT-CURRENT POWER

(75) Inventors: Takayoshi Ookita, Tokyo (JP); Ryota Saito, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 381 days.

(21) Appl. No.: 13/877,868

(22) PCT Filed: Dec. 13, 2010

(86) PCT No.: PCT/JP2010/072380

§ 371 (c)(1),
(2), (4) Date: Apr. 4, 2013

(87) PCT Pub. No.: WO2012/081075

PCT Pub. Date: Jun. 21, 2012

(65) Prior Publication Data

US 2013/0193274 A1 Aug. 1, 2013

(51) Int. Cl.
*B61L 25/02* (2006.01)
*B61L 15/00* (2006.01)

(52) U.S. Cl.
CPC ..... *B61L 25/02* (2013.01); *B61L 15/009* (2013.01); *B61L 15/0036* (2013.01); *B61L 15/0072* (2013.01)

(58) Field of Classification Search
CPC ... B61L 25/02; B61L 15/009; B61L 15/0036; B61L 15/0072; B61L 25/00
USPC ..... 307/9.1
See application file for complete search history.

(56) References Cited

U.S. PATENT DOCUMENTS 8,799,965 B2 * 8/2014 Morimoto et al. ..... 725/75
8,909,422 B2 * 12/2014 Morimoto et al. ..... 701/36

(Continued)

FOREIGN PATENT DOCUMENTS

JP 02-079196 A 3/1990
JP 02079196 A * 3/1990

(Continued)

OTHER PUBLICATIONS

First Office Action issued on Oct. 27, 2014, by the Chinese Patent Office in corresponding Chinese Patent Application No. 201080070667.9, and an English translation of the Office Action. (17 pages).

(Continued)

*Primary Examiner* — Jared Fureman
*Assistant Examiner* — Michael Warmflash
(74) *Attorney, Agent, or Firm* — Buchanan Ingersoll & Rooney PC

(57) ABSTRACT

An in-vehicle information display system includes a plurality of display devices each of which operates by receiving supply of alternating-current power obtained by converting power from a wiring or of direct-current power output from a power storage device and each of which performs guidance display to passengers, and a terminal device that operates by receiving supply of direct-current power from the power storage device and that distributes guidance display information used for the guidance display toward the display devices. The terminal device directly transmits the guidance display information to a part of the display devices, each of the display devices acquires the guidance display information from the terminal device either directly or via another display device, and the display device that acquires the guidance display information directly from the terminal device among the display devices operates by receiving supply of direct-current power from the power storage device.

11 Claims, 6 Drawing Sheets

(56) References Cited

U.S. PATENT DOCUMENTS

| | | | | |
|---|---|---|---|---|
| 2006/0170285 | A1* | 8/2006 | Morimitsu et al. | 307/3 |
| 2008/0295138 | A1* | 11/2008 | Emoto et al. | 725/81 |
| 2009/0122843 | A1* | 5/2009 | Mitsuhashi et al. | 375/211 |

FOREIGN PATENT DOCUMENTS

| | | | | |
|---|---|---|---|---|
| JP | 06-036153 | A | | 2/1994 |
| JP | 09-051601 | A | | 2/1997 |
| JP | 10-117401 | A | | 5/1998 |
| JP | 11-005534 | A | | 1/1999 |
| JP | 11005534 | A | * | 1/1999 |
| JP | 2002-127905 | A | | 5/2002 |
| JP | 2002-262407 | A | | 9/2002 |
| JP | 2003-284201 | A | | 10/2003 |
| JP | 2003284201 | A | * | 10/2003 |
| JP | 2008-113347 | A | | 5/2008 |
| JP | 2008-302776 | A | | 12/2008 |
| JP | 2008302776 | A | * | 12/2008 |
| JP | 2009-015239 | A | | 1/2009 |

OTHER PUBLICATIONS

International Search Report (PCT/ISA/210) issued on Jan. 25, 2011, by the Japanese Patent Office as the International Searching Authority for International Application No. PCT/JP2010/072380.

Written Opinion (PCT/ISA/237) issued on Jan. 25, 2011, by the Japanese Patent Office as the International Searching Authority for International Application No. PCT/JP2010/072380.

Office Action for Japanese Application No. 2011-518979 dated Apr. 1, 2013 (8 total pages).

* cited by examiner

IN-VEHICLE INFORMATION DISPLAY SYSTEM AND METHOD IMPLEMENTING ALTERNATING-CURRENT POWER AND DIRECT-CURRENT POWER

FIELD

The present invention relates to an in-vehicle information display system for notifying passengers of information such as advertisements and an operation status in each vehicle of a train.

BACKGROUND

In recent years, it is generally seen in railway vehicles to install display devices such as LCD displays near doors within passenger compartments and to provide various information such as operation statuses and advertisements to passengers by using these display devices. Furthermore, systems for providing information in the form of not only simple texts and static images but also videos are becoming popular (see, for example, Patent Literatures 1 and 2). There is also known a configuration in which two LCD displays are installed as a pair on a panel portion at the top of a door, one being used to provide information such as an operation status (used for guidance display), and the other being used to provide advertisement information.

Patent Literature 3 describes an in-train broadcasting distribution system for distributing TV broadcast programs into a train. This in-train broadcasting distribution system relays broadcast signals received by an antenna between transmission devices installed in respective vehicles and forming a ring network, and multicasts the broadcast signals from each transmission device to each user terminal. This realizes a reduction in a line capacity necessary to distribute the broadcast signals and an improvement in failure tolerance.

CITATION LIST

Patent Literatures

Patent Literature 1: Japanese Patent Application Laid-open No. 2002-127905

Patent Literature 2: Japanese Patent Application Laid-open No. 2009-015239

Patent Literature 3: Japanese Patent Application Laid-open No. 2008-113347

SUMMARY

Technical Problem

When suspension, delay, or the like of train operations occur, such information is possibly provided to passengers by displaying the information on a display device in a vehicle in addition to usual guidance display. However, for example, when a natural disaster, an accident or the like occurs, power supply from wirings possibly stops. It is desired to realize a system that can continue providing information even when a failure such as the stop of power supply from the wirings occurs.

The present invention has been achieved to solve the above problems, and an object of the present invention is to provide an in-vehicle information display system and a guidance-information processing method that can provide necessary information to passengers even when a failure occurs in a power system of a vehicle such as when power supply from a wiring stops.

Solution to Problem

There is provided an in-vehicle information display system according to an aspect of the present invention including: a plurality of display devices each of which operates by receiving supply of alternating-current power obtained by converting power from a wiring or of direct-current power output from a power storage device in a train, and each of which performs guidance display relating to a train operation to passengers; and a terminal device that operates by receiving supply of direct-current power from the power storage device, and that distributes guidance display information that is information used for the guidance display toward the display devices, wherein the terminal device directly transmits the guidance display information to a part of the display devices among the display devices, each of the display devices acquires the guidance display information from the terminal device either directly or via another display device, and the part of the display devices that acquires the guidance display information directly from the terminal device among the display devices operates by receiving supply of direct-current power from the power storage device.

Advantageous Effects of Invention

According to the present invention, a terminal device and display devices directly receiving information from this terminal device in each vehicle operate by receiving power supply from a power storage device within a train. Accordingly, it is possible to continue performing guidance display even when the power supply from a wiring stops, when a power collector fails, or when a power conversion device that converts the power supplied from the wiring into power for operating the display devices fails.

DESCRIPTION OF EMBODIMENTS

Exemplary embodiments of an in-vehicle information display system and a guidance-information processing method according to the present invention will be explained below in detail with reference to the accompanying drawings. The present invention is not limited to the embodiments.

Embodiment

<Explanations of Overall Configuration>

Figure 1:
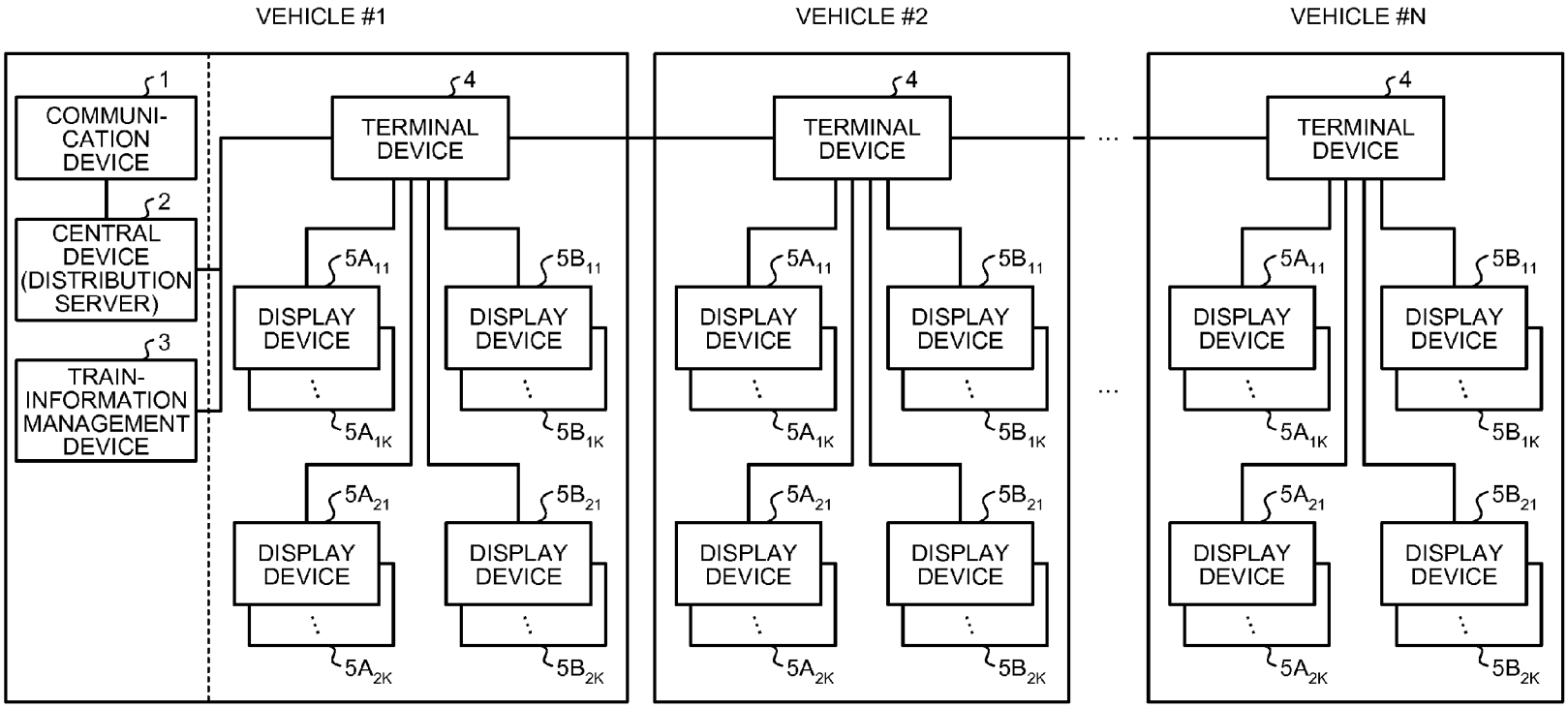
FIG. 1 is an example of an overall configuration of an in-vehicle information display system according to the present invention.

FIG. 1 is an example of an overall configuration of an in-vehicle information display system according to the present invention. As shown in FIG. 1, the in-vehicle information display system is installed in a train in which vehicles #1 to #N are coupled together. As common constituent elements, a terminal device 4 and a plurality of display devices $5A_{11}$ to $5A_{1K}$, $5A_{21}$ to $5A_{2K}$, $5B_{11}$ to $5B_{1K}$, and $5B_{21}$ to $5B_{2K}$ are installed in each of the vehicles. A communication device 1, a central device (distribution server) 2, and a train-information management device 3 are additionally installed in, for example, the vehicle #1 that is a lead vehicle. Alternatively, the communication device 1, the central device 2, and the train-information management device 3 can be installed in a vehicle other than the vehicle #1, or in different vehicles, from one another.

In FIG. 1, the communication device 1 transmits or receives data to or from each of ground-based stations (not shown) installed at stations or the like. The central device 2 distributes the data acquired from each of the ground-based stations via the communication device 1 or moving image data held in advance to the terminal device 4 of each vehicle. The train-information management device 3 collects and manages train information to be described later.

The terminal devices 4 installed in the respective vehicles are connected to one another via a transmission path. The terminal device 4 of the vehicle in which the central device 2 is installed is connected to the central device 2 and the train-information management device 3. When receiving data from the central device 2, the terminal device 4 holds the received data and also transfers the received data to the other terminal devices 4. When receiving the data output from the central device 2 and relayed by the other terminal devices 4, each of the terminal devices 4 installed in the vehicles other than the vehicle in which the central device 2 is installed transfers the received data to another terminal device 4, as long as another terminal device 4 adjacent to the terminal device 4 on the transmission path is present. The transmission path is described later in detail.

Each display device (each of the display devices $5A_{11}$ to $5A_{1K}$, $5A_{21}$ to $5A_{2K}$, $5B_{11}$ to $5B_{1K}$, and $5B_{21}$ to $5B_{2K}$) operates by receiving the supply of DC power or AC power. Furthermore, the display device is installed on a wall surface within each vehicle (for example, a panel portion at a top of a door), and displays guidance based on train operation information, emergency information, or the like, an advertisement constituted by still images or moving images (videos), or the like in response to an instruction or the like from the terminal device 4. In the present embodiment, it is assumed that two display devices are handled as one pair. These paired display devices are installed to be arranged side by side. One of the paired display devices is used for guidance display for notifying passengers of train operation information, emergency information, and the like, and the other is used for advertisement display.

In the following explanations, the display devices 5A ($5A_{11}$ to $5A_{1K}$ and $5A_{21}$ to $5A_{2K}$) are assumed to be used for guidance display, and the display devices 5B ($5B_{11}$ to $5B_{1K}$ and $5B_{21}$ to $5B_{2K}$) are assumed to be used for advertisement display. It is also assumed that each of the display devices $5A_{11}$ to $5A_{1K}$ and $5B_{11}$ to $5B_{1K}$ is the display device installed on one of wall surfaces within each vehicle and that each of the display devices $5A_{21}$ to $5A_{2K}$ and $5B_{21}$ to $5B_{2K}$ is the display device installed on the other wall surface. The description of "display devices 5" represents all the display devices $5A_{11}$ to $5A_{1K}$, $5A_{21}$ to $5A_{2K}$, $5B_{11}$ to $5B_{1K}$, and $5B_{21}$ to $5B_{2K}$. The description of "display devices 5A" represents all the display devices $5A_{11}$ to $5A_{1K}$ and $5A_{21}$ to $5A_{2K}$ (display devices for guidance display). The description of "display devices 5B" represents all the display devices $5B_{11}$ to $5B_{1K}$ and $5B_{21}$ to $5B_{2K}$ (display devices for advertisement display).

Figure 2:
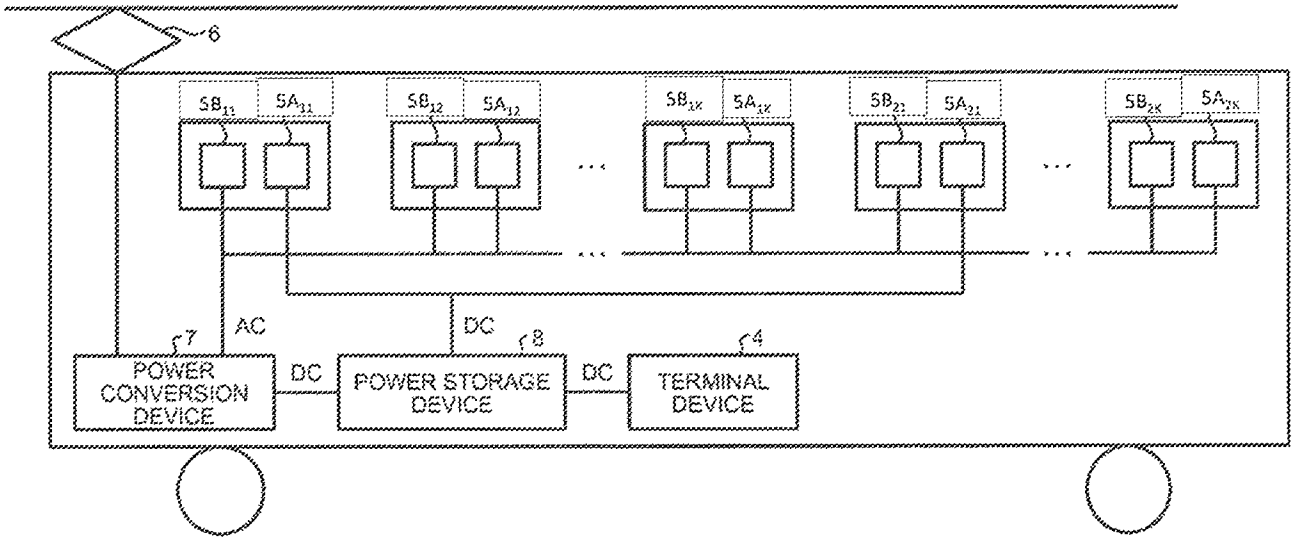
FIG. 2 is an example of a power supply path for supplying power to a terminal device and respective display devices.

FIG. 2 is an example of a power supply path for supplying power to the terminal device 4 and the respective display devices 5 installed in one vehicle. The vehicle shown in FIG. 2 includes the terminal device 4, the plurality of display devices 5, a power collector 6, a power conversion device 7, and a power storage device 8 (for example, a battery). In the vehicle shown in FIG. 2, the power conversion device 7 receives power supply from a wiring via the power collector 6 such as a pantograph and converts the power into DC power and AC power each at a desired voltage. The DC power is used for charging the power storage device 8 whereas the AC power is used for operating all the display devices 5B and a part of the display devices 5A. The terminal device 4 and a part of the display devices 5A (the display devices 5A to which the AC power is not supplied from the power conversion device 7) operate by receiving the supply of DC power from the power storage device 8. A power supply path is the same, whether the power supplied from the wiring is the DC power or the AC power. The difference is only a configuration (an operation) of the power conversion device 7. The terminal device 4 can operate by receiving the power supply directly from the power conversion device 7 at normal times and can operate by receiving the power supply from the power storage device 8 only in a case of emergency as long as the terminal device 4 can detect a state where the power supply from the power conversion device 7 stops because of a power failure of the wiring or a malfunction in the power conversion device 7.

While FIG. 2 is an example of the power supply path in the vehicle (other than the vehicle #1 shown in FIG. 1) that does not include the communication device 1, the central device 2, and the train-information management device 3, the same holds true for a power supply path for the terminal device 4 and each of the display devices 5 in the vehicle #1. The communication device 1, the central device 2, and the train-information management device 3 operate by the DC power from the power storage device 8. By configuring the power storage device 8 so as to supply power to the terminal device 4 and a part of the display devices 5A in each vehicle, it is possible to continue providing guidance information (guidance display) using the display devices 5A operating by the DC power even when the power collector 6 or the power conversion device 7 fail or when the power supply from the wiring stops. Furthermore, by configuring only a part of the display devices 5A to operate by the power supplied from the power storage device 8, it is possible to make an amount of power consumption to a minimum necessary amount and to thereby suppress wearing of the power storage device 8 after the power storage device 8 turns into a state of being unable to be charged with power because of a malfunction or the like. The number of the display devices 5A made to operate by the power supplied from the power storage device 8 is decided based on a storage capacity of the power storage device 8, for example. Conversely, the storage capacity of the installed power storage device 8 can be decided based on the number of the display devices 5A made to operate by the power from the power storage device 8.

While FIG. 2 depicts a power supply path in the vehicle that includes the power collector 6, the power conversion device 7, and the power storage device 8, it is possible to configure the power collector 6, the power conversion device 7, and the power storage device 8 to be installed not in each of all of the vehicles but in each of some of the vehicles. In a case of installing the power collector 6, the power conversion device 7, and the power storage device 8 in each of some of the vehicles, the terminal device 4 and a part of the display devices 5A in a vehicle in which the power storage device 8 is not installed operate by receiving the supply of DC power from the power storage device 8 installed in another vehicle. Furthermore, when the train includes a power storage device for driving electric motors (motors) and a power storage device for auxiliary driving, these power storage devices can be used as the power storage devices 8.

Figure 3:
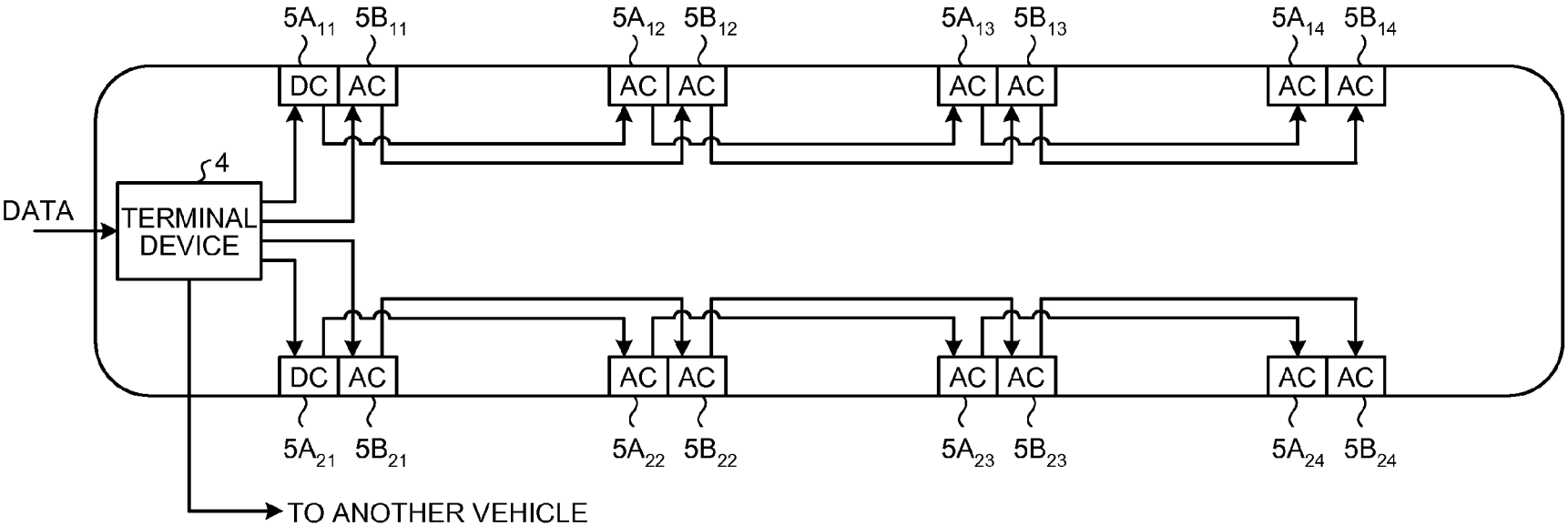
FIG. 3 is an example of an information transmission path from a terminal device to respective display devices in a vehicle.

FIG. 3 is an example of an information transmission path from the terminal device 4 to the display devices 5 in a vehicle. Information transmitted from the terminal device 4 to each display device 5 includes information used for guidance display (hereinafter, "guidance display information"), information used for advertisement display (hereinafter, "advertisement display information"), and control information such as a guidance display instruction and an advertisement display instruction. In FIG. 3, a display device indicated with DC is a display device that operates by receiving the supply of DC power from the power storage device 8 shown in FIG. 2, and a display device indicated with AC is a display device that operates by receiving the supply of AC power from the power conversion device 7 shown in FIG. 2.

Examples of the guidance display information include information on a line on which the train runs (information on each station on the line, train schedules, information on stops for every train type, and the like), line operation information (information on operation delay and operation suspension that occurs to the line on which the train itself runs and nearby lines), information on the train itself (position information while the train is running and the like), and information on an emergency guidance (guidance information on escape routes and the like). This guidance display information is relatively small in capacity and can be held individually in each display device 5A.

The advertisement display information is large-capacity data such as moving images and is difficult to hold individually in each display device 5B.

The control information is information for instructing a content to be displayed on each display device 5 by the terminal device 4. Each display device 5 performs display at a timing and with the content indicated by the control information received from the terminal device 4 to passengers. Types of this control information are classified into two, that is, control information for the guidance display and control information for the advertisement display. The terminal device 4 can generate different control information among the display devices 5 and transmit the control information to the respective display devices 5. It is thereby possible to provide information having contents different among the display devices 5 to the passengers. For example, by displaying detailed facility guidance different among the display devices 5A according to positions of the respective display devices 5A, it is possible to provide passenger-friendly information. Furthermore, by changing the guidance on the respective display devices 5A at the time of abnormality or emergency of the train, it is possible to provide a guidance (for example, escape routes) to the passengers according to the abnormal state.

Returning to the explanations of FIG. 3, in the in-vehicle information display system according to the present embodiment, the respective display devices 5 in one vehicle are classified into four groups depending on purposes and installation positions of the display devices 5 (whether the display device 5 is used for the guidance display or the advertisement display and on which wall surface of the vehicle the display device 5 is installed), as shown in FIG. 3. The terminal device 4 transmits information to a representative display device 5 in each of the groups. The display device 5 transfers the received information to the adjacent display device 5 among those in the same group.

In the example shown in FIG. 3, the terminal device 4 transmits the guidance display information to the display devices $\mathbf{5}A_{11}$ and $\mathbf{5}A_{21}$ and transmits the advertisement display information to the display devices $\mathbf{5}B_{11}$ and $\mathbf{5}B_{21}$. As for the control information, the terminal device 4 transmits the control information for the guidance display to the display devices $\mathbf{5}A_{11}$ and $\mathbf{5}A_{21}$ and that for the advertisement display to the display devices $\mathbf{5}B_{11}$ and $\mathbf{5}B_{21}$. The guidance display information and the control information for the guidance display are transferred in an order of the display device $\mathbf{5}A_{11}$→the display device $\mathbf{5}A_{12}$→the display device $\mathbf{5}A_{13}$→the display device $\mathbf{5}A_{14}$, or an order of the display device $\mathbf{5}A_{21}$→the display device $\mathbf{5}A_{22}$→the display device $\mathbf{5}A_{23}$→the display device $\mathbf{5}A_{24}$, and distributed to all the display devices 5A in the vehicle. The advertisement display information and the control information for the advertisement display are transferred in an order of the display device $\mathbf{5}B_{11}$→the display device $\mathbf{5}B_{12}$→the display device $\mathbf{5}B_{13}$→the display device $\mathbf{5}B_{14}$, or an order of the display device $\mathbf{5}B_{21}$→the display device $\mathbf{5}B_{22}$→the display device $\mathbf{5}B_{23}$→the display device $\mathbf{5}B_{24}$, and distributed to all the display devices 5B in the vehicle.

Among the display devices 5A, the display devices $\mathbf{5}A_{11}$ and $\mathbf{5}A_{21}$ that directly receive the information from the terminal device 4 are the display devices operating by receiving the supply of DC power from the power storage device 8 as described above. That is, the terminal device 4 transmits the information directly to the display devices 5A operating by the DC power supply and the display devices 5B paired with the display devices 5A. It is thereby possible for the display devices 5A operating by the DC power (the display devices $\mathbf{5}A_{11}$ and $\mathbf{5}A_{21}$ in the example of FIG. 3) to normally operate and to provide the guidance display to the passengers even when the power conversion device 7 stops supplying AC power to the display devices 5. The number of display devices 5 operating by the DC power for each group can be set to be plural. In this case, each display device 5 operating by the DC power is assumed to satisfy a relation to the effect that the display device directly receives the information from the terminal device 4 or receives the information transferred from another display device operating by the DC power. That is, it is assumed that all the display devices 5 operating by the DC power receive information earlier than any of the display devices 5 operating by the AC power.

The information distribution order in each group is not limited to those shown in FIG. 3. For example, the information from the terminal device 4 can be distributed first to the display devices $\mathbf{5}A_{12}$, $\mathbf{5}A_{22}$, $\mathbf{5}B_{12}$, and $\mathbf{5}B_{22}$, and then transferred from these display devices to the adjacent display devices in the same groups, respectively. Alternatively, the information from the terminal device 4 can be distributed first to the display devices $\mathbf{5}A_{11}$, $\mathbf{5}A_{24}$, $\mathbf{5}B_{11}$, and $\mathbf{5}B_{24}$ and then transferred from these display devices to the adjacent display devices in the same groups, respectively. In another alternative, the display devices 5A (the display devices $\mathbf{5}A_{11}$ and $\mathbf{5}A_{24}$) installed near vehicle ends can directly receive the information from the terminal device 4. With this configuration, when the supply of AC power stops, both passengers present in the front area of the vehicle and those present in the rear area thereof can highly likely check the guidance display and it is possible to efficiently provide information. Needless to say, the information can be distributed in orders other than these orders. In any case, the display devices 5A directly receiving the information from the terminal device 4 operate by the DC power from the power storage device 8.

Figure 4:
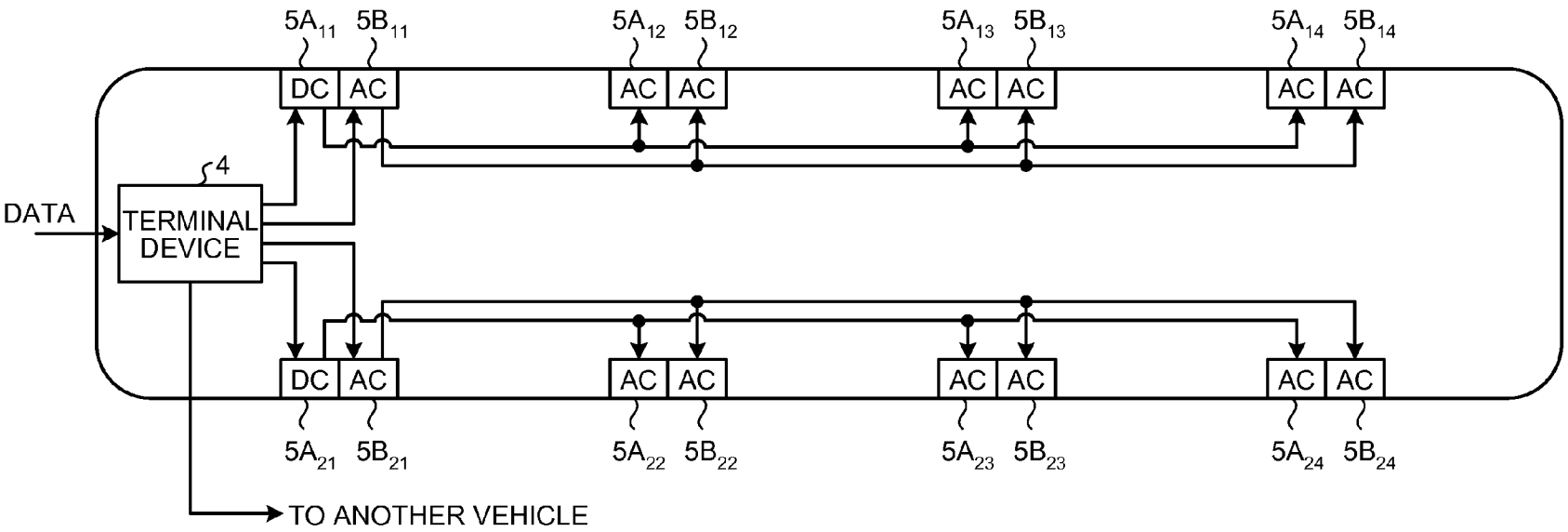
FIG. 4 is an example of an information transmission path from a terminal device to respective display devices in a vehicle.

Furthermore, FIG. 3 is an example in which the display devices in each group transfer the information to the adjacent display devices, respectively. Alternatively, as shown in FIG. 4, the display devices 5 (the display devices $5A_{11}$, $5A_{21}$, $5B_{11}$, and $5B_{21}$ in an example of FIG. 4) directly receiving the information from the terminal device 4 can directly transmit the information to all the other display devices 5 in the same group, respectively.

<Explanations of Respective Constituent Elements>

Respective constituent elements shown in FIG. 1 are explained next.

(Communication Device 1)

The communication device 1 communicates with the ground-based stations that are not shown in FIG. 1 and receives information to be distributed to each vehicle by the central device 2. The communication device 1 also transmits information on the train itself to each ground-based station. The information received from each base station includes operation information on a line on which the train is running and the nearby lines (whether the train runs as scheduled, detailed information when the train schedule is disrupted, and the like), news, and the like. The information transmitted to each ground-based station is the information received from the train-information management device 3, for example. When receiving the information from each ground-based station, the communication device 1 outputs this information to the central device 2.

(Central Device 2)

The central device 2 distributes the information to the terminal devices 4 in the own vehicle (the vehicle #1) and those in the other vehicles when receiving the information that the communication device 1 receives from each ground-based station. Furthermore, the central device 2 holds, in advance, information on videos and the like to be reproduced on the display devices 5B for advertisement display installed in each vehicle, and distributes the held information to each of the display devices 5B at a predetermined timing. The central device 2 transmits the information (the information received from the communication device 1 and the held information) first to the terminal device 4 of the own vehicle, and the terminal device 4 that receives the information transmitted from the central device 2 transfers the received information to the other terminal devices 4.

(Train-Information Management Device 3)

The train-information management device 3 collects information from devices installed in the respective vehicles such as doors, air-conditioners, brakes, motors, ATOs (automatic train operations), SIVs (static inverters serving as auxiliary power supplies), and automatic broadcasting devices, and manages these pieces of information as train information. Furthermore, the train-information management device 3 transmits all of or a part of the managed train information to each terminal device 4 as needed. For example, when receiving a request from one of the terminal devices 4, the train-information management device 3 transmits information indicated by a requested content to the requester terminal device 4. The train-information management device 3 also transmits urgent information necessary to be promptly provided to passengers to each terminal device 4 as soon as the train-information management device 3 acquires the information.

(Terminal Device 4)

Figure 5:
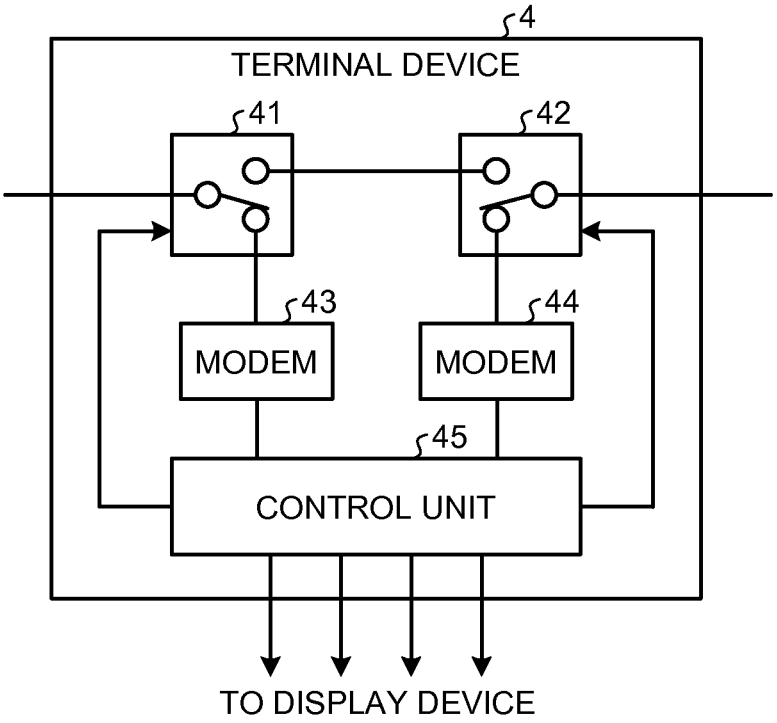
FIG. 5 is a configuration example of a terminal device.

FIG. 5 is a configuration example of the terminal device 4. As shown in FIG. 5, the terminal device 4 includes path switching units 41 and 42, modems 43 and 44, and a control unit 45.

The path switching units 41 and 42 switch transmission paths for various information received directly from the central device 2 or received via another terminal device 4 in response to an instruction from the control unit 45. The modems 43 and 44 modulate or demodulate the information transmitted or received to or from the central device 2 or the other terminal devices 4.

The control unit 45 transfers the various information received directly from the central device 2 or received via another terminal device 4 to the display devices 5 and another adjacent terminal device 4, and distributes the various information to each display device 5 in the own vehicle. The control unit 45 also generates control information for instructing the content to be displayed on each display device 5, a display timing, and the like, and transmits the control information to the control target display devices 5. Furthermore, the control unit 45 monitors an operation performed by the modem 43 or 44. When occurrence of a malfunction in the modem is detected, it is impossible to correctly demodulate and transmit the information received from the central device 2 (it is impossible to perform display using the information from the central device 2 on each of the display devices 5 in the vehicle and further impossible to transmit the information downstream). Accordingly, the control unit 45 controls the path switching units 41 and 42 to be directly connected to each other. The information from the central device 2 is thereby bypassed to make it possible to prevent the modem malfunction from influencing the other vehicles. That is, it is possible to prevent the data passing through the defective modem from being transferred to the other vehicles, and the vehicles receiving this data from being unable to normally provide information to passengers although there is no malfunction in the terminal devices 4 or the display devices 5.

(Display Device 5)

Figure 6:
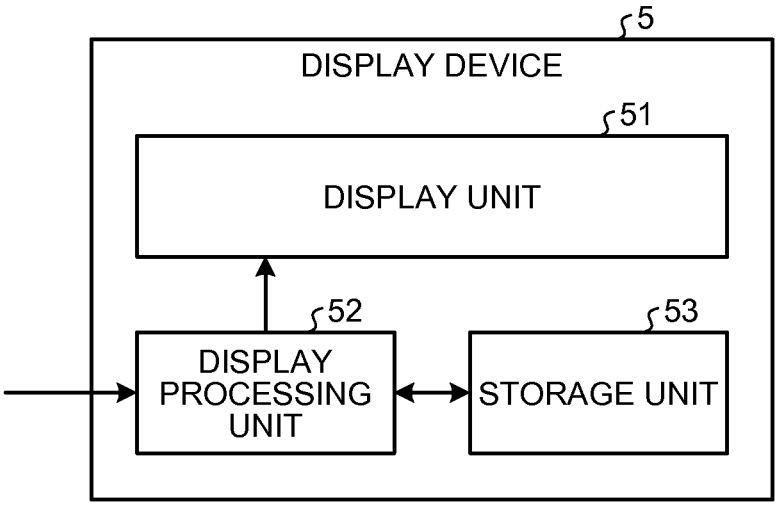
FIG. 6 is a configuration example of a display device.

FIG. 6 is a configuration example of the display device 5. As shown in FIG. 6, the display device 5 includes a display unit 51 such as an LCD display panel, a display processing unit 52, and a storage unit 53.

The display unit 51 performs guidance display or advertisement display in response to an instruction from the display processing unit 52. When the display device including the display processing unit 52 is the display device 5A for guidance display, the display processing unit 52 generates data for a guidance display screen to be displayed on the display unit 51 based on an instruction content (control information) received from the terminal device 4 and the guidance display information received from the terminal device 4 and held in the storage unit 53. On the other hand, when the display device is the display device 5A for advertisement display, the display unit 51 generates data for an advertisement display screen to be displayed on the display unit 51 based on the instruction content (control information) received from the terminal device 4 and the advertisement display information such as video information received from the terminal device 4. The display processing unit 52 can be realized by hardware such as a CPU and predetermined software cooperating with this hardware.

The storage unit 53 stores therein the guidance display information, information used to generate the guidance display screen (for example, images, moving images, and text to be displayed on the guidance display screen), and the like received from the terminal device 4. Furthermore, the storage unit 53 includes a memory area (work area) temporarily used for a video processing or the like performed by the display processing unit 52. The storage unit 53 can be realized by a combination of a RAM and a ROM. Alternatively, an interface for connecting a detachable external memory (an external storage device) to the display device 5 can be provided on the storage unit 53 so as to be able to increase a capacity by connecting the external memory to the display device 5 as needed. In this case, by connecting the external memory in which the guidance display information or the advertisement display information is written in advance to the display device 5, the display device 5 can perform guidance display or advertisement display using the information stored in this external memory. Furthermore, by connecting external memories in which different information is written to the display devices 5, respectively, the display devices 5 can perform the guidance display or the advertisement display having contents different among the display devices 5. Furthermore, even when the information is not distributed from the terminal device 4 because of an occurrence of a malfunction in the terminal device 4, an occurrence of a failure in the information transmission path, or the like, each display device 5 can perform the guidance display (for example, to the effect that an information reception failure occurs) using the information held in the storage unit 53. It is also possible to rewrite the information in an external memory using the data transmitted from a base side via the communication device 1 or using the data stored in the central device 2 either by batch processing or for every display device.

<Explanations of Display Control Operation in Respective Vehicles>

Figure 7:
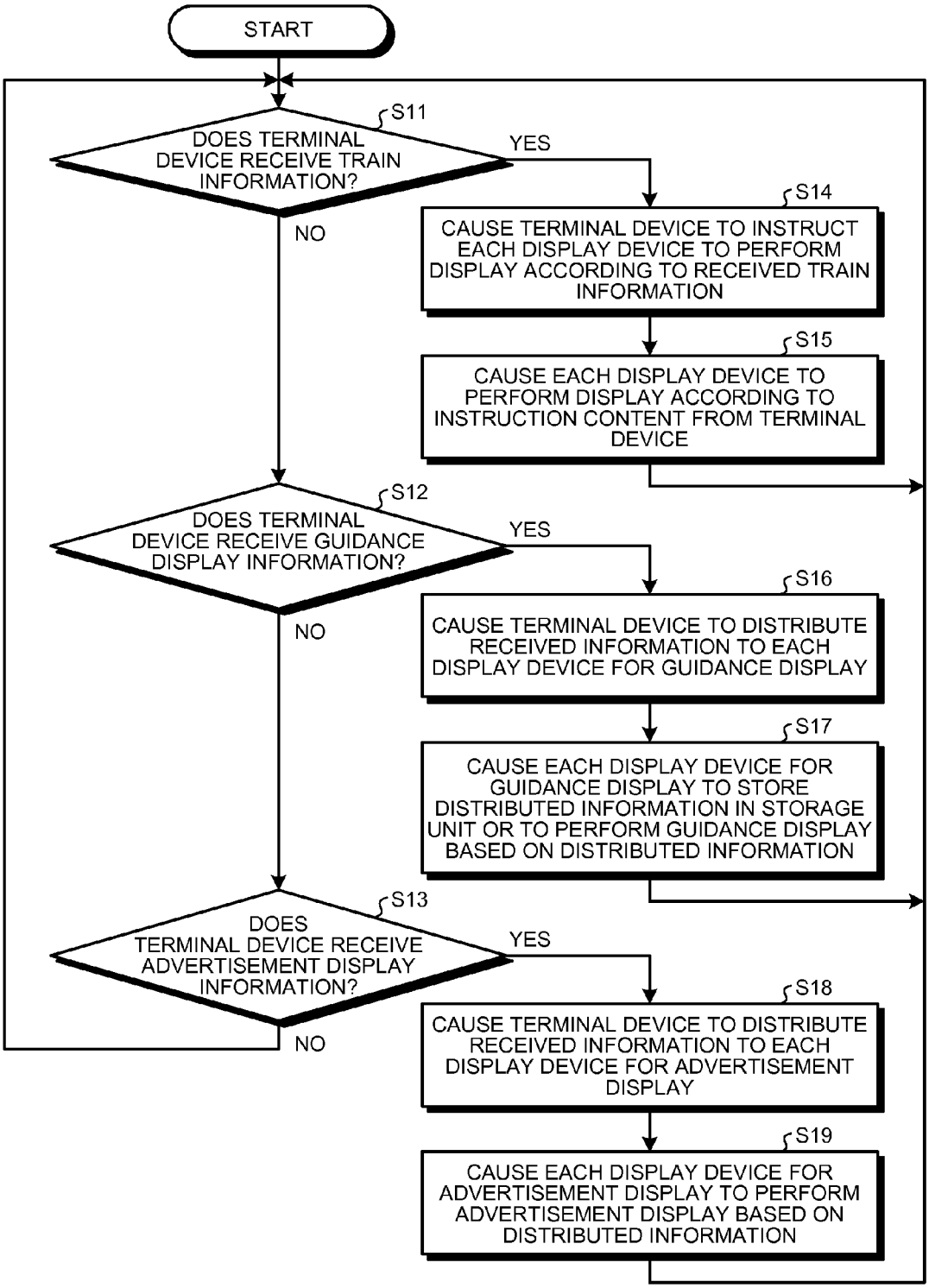
FIG. 7 is a flowchart of an example of operations performed by a terminal device and display devices in respective vehicles.

An operation performed when the display devices 5 installed in each vehicle perform guidance display or advertisement display is described next with reference to FIG. 7. FIG. 7 is a flowchart of an example of operations performed by the terminal device 4 and the display devices 5 in respective vehicles.

In each vehicle, the terminal device 4 monitors whether the train-information management device 3 transmits train information, and monitors whether the central device 2 transmits guidance display information and advertisement display information (Steps S11, S12, and S13).

As a result of monitoring operations at Steps S11 to S13, when the train information is transmitted (YES at Step S11), the terminal device 4 generates instruction information (control information) for performing display according to the received train information on each display device 5 and transmits the instruction information to each display device 5 (Step S14).

For example, when acquiring information on a current position of a train as train information, the terminal device 4 determines whether it is necessary to change a display content to be displayed on each display device 5 while linking the display content to the position indicated by the acquired information. When it is necessary to change the display content, the terminal device 4 generates control information that instructs for a change to each of the corresponding display devices 5. When an advertisement to be displayed while being linked to the current position is present, the terminal device 4 generates control information indicating an advertisement content to be displayed and transmits the control information to each display device 5B for advertisement display. When it is necessary to execute such a control as to display guidance of a current running position or to display guidance of an arrival to a next stop while linking the guidance to the current position, the terminal device 4 generates control information indicating a content of the guidance to be displayed and transmits the control information to each display device 5A for guidance display. Each display device 5 displays the content according to the instruction content from the terminal device 4 (Step S15). As described later, if each of the display devices 5 already recognizes the purposes of the own display device (whether it is for guidance display or for advertisement display), the terminal device 4 can distribute the received train information as it is to all the display devices 5.

When the guidance display information is transmitted (YES at Step S12), the terminal device 4 distributes the received guidance display information to each display device 5A for guidance display (Step S16). Each display device 5A stores the distributed guidance display information in the storage unit 53 or performs the guidance display based on the distributed information (Step S17). Specifically, when the distributed guidance display information is information (for example, line information) used for usual guidance display that is not urgent, each display device 5A stores and holds the received information in the storage unit 53. At this time, if receiving latest information on the information held so far (information having an updated content), each display device 5A updates (overwrites) the held old information to the latest information. When urgent guidance display information (for example, information indicating an occurrence of an earthquake, an accident, or a malfunction) is transmitted to each display device 5A, the display device 5A performs emergency guidance display based on this information.

Furthermore, when advertisement display information is transmitted (YES at Step S13), the terminal device 4 distributes the received advertisement display information to each display device 5B for advertisement display (Step S18). Each display device 5B performs advertisement display based on the distributed advertisement display information (Step S19). For example, when video information is transmitted as the advertisement display information, each display device 5B decodes the received video information and reproduces a video (a moving image content).

In the present embodiment, the operation performed by the terminal device 4 when the terminal device 4 checks types of the information to be distributed to each display device 5, allocates the information to the display devices 5A for guidance display and the display devices 5B for advertisement display, generates the control information for instructing display contents, a display timing, and the like, and transmits the generated control information to each display device 5 has been described. However, functions of the terminal device 4 can be limited only to transferring information to the other terminal devices 4 and distributing the information to the display devices in the vehicle. That is, the terminal device 4 can distribute the information received from the central device 2 and the train-information management device 3 to all the display devices 5 (distribute the same information to all the display devices 5 irrespectively of the purposes of the display devices). In addition, each of the display devices 5 can select necessary information according to the purposes of the own display device 5 (whether it is for guidance display or for advertisement display), and perform guidance display or advertisement display. For example, by writing information indicating the purposes in a specific area of the storage unit 53 in advance, each display device 5 can recognize the purposes of the own device.

Furthermore, each display device 5 can perform the following operation because the display device 5 includes the display processing unit 52 and the storage unit 53. That is, the display device 5 holds information on an installation position of the display device 5 itself (at which location in the vehicle the display device 5 is installed) in the storage unit 53. In addition, each of the information distributed from the terminal device 4 is made to include installation position information indicating the display device 5 at which installation position the information is directed to. The terminal device 4 distributes the same information to all the display devices 5. When receiving the information distributed from the terminal device 4, each display device 5 checks the installation position information included in this information and determines whether the information is one to be handled by the device itself. When determining that the information is one to be handled by the device itself, the display device 5 performs guidance display or advertisement display using this information. The above operation enables the guidance display or the advertisement display having contents different among the display devices 5.

In this way, the in-vehicle information display system according to the present embodiment includes the terminal device and a plurality of display devices that perform either the guidance display or the advertisement display in response to an instruction from this terminal device, the terminal device and the display devices being installed in each vehicle of the train, and the terminal device and a part of the display devices that perform the guidance display operate by receiving power supply from the power storage device in the train. Furthermore, the display devices operating by receiving the power supply from the power storage device in the train receive the information necessary for the guidance display either directly from the terminal device or via only other display devices operating by receiving the power supply from the power storage device in the train. With this configuration, it is possible to continue the guidance display using a part of the display devices and to provide emergency guidance display to passengers even when the power supply from the wiring stops because of a blackout or the like, when the current collector has a malfunction, or when the power conversion device that converts power supplied from the wiring into power for operating the display devices fails. By performing emergency guidance display using the display devices, there is a higher probability that the passengers can grasp the situation by looking at the guidance of images (pictures) or characters even when it is difficult to hear an emergency guidance by an announcement (audio). It is also possible to provide accurate information even to hearing-impaired passengers.

Furthermore, each display device can accurately display a guidance in an emergency without delay because the guidance display information is held in advance. Furthermore, because the respective display devices can hold different information (guidance display information), for example, it is possible for each display device to display a guidance including the content according to the installation position of the display device. Because display of escape routes at the time of escaping out of the vehicle may be different even in the same vehicle, it is possible to provide an accurate guidance according to passenger's positions.

In the present embodiment, the configuration of installing the display devices for guidance display and the display devices for advertisement display in a pair respectively has been described by way of an example. The present invention is also applicable to a case of using one display device for both the guidance display and the advertisement display. Even in this case, similarly to the present embodiment, it suffices to configure the in-vehicle information display system so that a part of the display devices are made to operate by the power supplied from the power storage device and to directly receive the information from the terminal device. Furthermore, while a case of a train in which a plurality of vehicles are coupled together has been explained above, the present invention is also applicable to a single-car train.

INDUSTRIAL APPLICABILITY

As described above, the present invention is useful as an in-vehicle information display system for performing guidance display and advertisement display in a vehicle.

REFERENCE SIGNS LIST

1 communication device
2 central device (distribution server)
3 train-information management device
4 terminal device
5$A_{11}$ to 5$A_{14}$, 5$A_{1K}$, 5$A_{21}$ to 5$A_{24}$, 5$A_{2K}$ display device (for guidance display)
5$B_{11}$ to 5$B_{14}$, 5$B_{1K}$, 5$B_{21}$ to 5$B_{24}$, 5$B_{2K}$ display device (for advertisement display)
6 current collector
7 power conversion device
8 power storage device
41, 42 path switching unit
43, 44 modem
45 control unit
51 display unit
52 display processing unit
53 storage unit

The invention claimed is:

1. An in-vehicle information display system comprising:

a plurality of display devices with a first subset of devices and a second subset of devices, the first subset of devices operates by receiving supply of only alternating-current power obtained by converting power from a wiring, and the second subset of devices operates by receiving supply of only direct-current power output from a power storage device in a train, and each of the devices performs guidance display relating to a train operation to passengers, wherein the first subset of devices and the second subset of devices are different subsets within the plurality of display devices; and a terminal device that operates by receiving supply of direct-current power from the power storage device, and that distributes guidance display information that is information used for the guidance display toward the display devices, wherein the terminal device directly transmits the guidance display information to the second subset of display devices, each of the display devices acquires the guidance display information from the terminal device either directly or via another display device, among the display devices, the second subset of display devices that acquires the guidance display information directly from the terminal device operates by receiving supply of direct-current power from the power storage device, and the first subset of display devices acquires the guidance display information via the other display device and operates by receiving supply of alternating-current power obtained by converting power from the wiring, and the train includes a power storage device for motor driving or for auxiliary driving, and the power storage device for the motor driving or for the auxiliary driving is used as the power storage device for supplying direct-current power to the display devices.

2. The in-vehicle information display system according to claim 1, wherein the display devices are classified into a group of display devices each of which is installed on one side surface of a vehicle and a group of display devices each of which is installed on the other side surface of the vehicle, and have a connection relation of relaying the guidance display information within each of the groups and of transmitting the guidance display information to all of the display devices, each of the groups including the display device acquiring the guidance display information directly from the terminal device.

3. The in-vehicle information display system according to claim 2, wherein each of the display devices in a same group sequentially relays the guidance display information one-on-one.

4. The in-vehicle information display system according to claim 2, wherein, in each of the groups, the display device acquiring the guidance display information directly from the terminal device relays the guidance display information to all the remaining display devices in the same group.

5. The in-vehicle information display system according to claim 1, wherein the display device includes a display unit, and a display processing unit that generates display data to be displayed on the display unit based on the guidance display information.

6. The in-vehicle information display system according to claim 5, wherein the display device further includes a storage unit that holds screen generation information when acquiring the screen generation information as the guidance display information, the screen generation information being information used when generating a guidance display screen, when acquiring information related to a train operation from the terminal device, the display processing unit generates the guidance display screen to be displayed on the display unit based on the acquired information and the screen generation information held in the storage unit.

7. The in-vehicle information display system according to claim 1, wherein the terminal device determines whether modulated data that is the guidance display information can be normally demodulated when the modulated data is input from an outside, demodulates the modulated data and distributes the demodulated data to the display device when determining that the modulated data can be demodulated, and transfers the modulated data to a terminal device installed in another vehicle when determining that it is impossible to demodulate the modulated data.

8. The in-vehicle information display system according to claim 7, wherein the terminal device includes a first path switching unit that allocates the modulated data to a transfer path for transferring the modulated data into the vehicle or to a transfer path for transferring the modulated data to an outside of the vehicle when the modulated data is input from the outside, a first modem that receives the modulated data allocated to the transfer path for transferring the modulated data into the vehicle by the first path switching unit, and that demodulates the modulated data, a control unit that outputs the demodulated data that is demodulated by the first modem toward the display devices within the vehicle, and outputs the demodulated data toward the transfer path for transferring the demodulated data to the outside, a second modem that modulates the data output from the control unit toward the transfer path, and generates modulated data equivalent to the guidance display information before being demodulated by the first modem in order to standardize input data to an other display device that is a transferring destination to the demodulated data, and a second path switching unit that selects and outputs the modulated data allocated to the transfer path for transferring the modulated data to the outside of the vehicle by the first path switching unit, or the modulated data generated by the second modem, and the control unit further includes a function of detecting a malfunction in the first and second modems, and when detecting a malfunction, the control unit controls the first and second path switching units to bypass the modulated data input from the outside from the first path switching unit to the second path switching unit.

9. A guidance-information processing method executed by a vehicle, the vehicle including a plurality of display devices with a first subset of devices and a second subset of devices, the first subset operates by receiving supply of only alternating-current power obtained by converting power from a wiring, and the second subset of devices operates by receiving supply of only direct-current power output from a power storage device in a train, and each of the devices performs guidance display relating to a train operation to passengers, wherein the first subset of devices and the second subset of devices are different subsets within the plurality of display devices; and a terminal device that operates by receiving supply of direct-current power from the power storage device, and that distributes guidance display information that is information used for the guidance display toward the display devices, the guidance-information processing method comprising:

an information transmitting step of, by the terminal device, directly transmitting the guidance display information to the second subset of display devices; and an information acquiring step of, by each of the display devices, acquiring the guidance display information from the terminal device either directly or via another display device, wherein among the display devices, the second subset of display devices that acquires the guidance display information directly from the terminal device executes the information acquiring step by receiving supply of direct-current power from the power storage device, and the first subset of display devices acquires the guidance display information via the other display device and executes the information acquiring step by receiving supply of alternating-current power obtained by converting power from the wiring, and the train includes a power storage device for motor driving or for auxiliary driving, and the power storage device for the motor driving or for the auxiliary driving is used as the power storage device for supplying direct-current power to the display devices.

10. The guidance-information processing method according to claim 9, wherein the display device includes a display unit, a display processing unit that generates display data to be displayed on the display unit based on the guidance display information, and a storage unit that holds screen generation information when acquiring the screen generation information as the guidance display information, the screen generation information being information used when generating a guidance display screen, and the guidance-information processing method further comprises a guidance display screen generating step of, by the display processing unit, when acquiring information related to a train operation from the terminal device, generating the guidance display screen to be displayed on the display device based on the acquired information and the screen generation information held in the storage unit.

11. The guidance-information processing method according to claim 9, further comprising a data transfer step of, by the terminal device, determining whether modulated data that is the guidance display information can be normally demodulated when the modulated data is input from an outside, demodulating the modulated data and distributing the demodulated data to the display unit when determining that the modulated data can be demodulated, and transferring the modulated data to a terminal device installed in another vehicle when determining that it is impossible to demodulate the modulated data.

* * * * *